US005118220A

United States Patent [19]

Furumi et al.

[11] Patent Number: 5,118,220

[45] Date of Patent: Jun. 2, 1992

[54] METHOD OF BUILDING UNDERGROUND CAVERN AND TUNNELING MACHINE

[75] Inventors: Kihachior Furumi; Joji Nakamura, both of Kanagawa, Japan

[73] Assignee: Kabushiki Kaisha Kematsu Seisakusho, Japan

[21] Appl. No.: 465,251

[22] PCT Filed: Jun. 15, 1989

[86] PCT No.: PCT/JP89/00602

§ 371 Date: Aug. 8, 1990

§ 102(e) Date: Aug. 8, 1990

[87] PCT Pub. No.: WO89/12729

PCT Pub. Date: Dec. 28, 1989

[30] Foreign Application Priority Data

Jun. 15, 1988 [JP] Japan ..... 63-145621

[51] Int. Cl.[5] ..... E21D 13/02

[52] U.S. Cl. ..... 405/139; 299/33; 405/138

[58] Field of Search ..... 405/141, 140, 138, 139, 405/184, 146, 131, 130; 299/31-33

[56] References Cited

U.S. PATENT DOCUMENTS

| | | | |
|---|---|---|---|
| 528,367 | 10/1894 | Harris | 405/138 |
| 721,830 | 3/1903 | Perin | 405/140 X |
| 2,377,012 | 5/1945 | Jacobs | 405/139 |
| 3,413,811 | 12/1968 | Giacobino | 405/140 |
| 3,968,655 | 7/1976 | McGlothlin | 405/138 X |
| 4,459,064 | 7/1984 | Berset | 405/138 |
| 4,929,123 | 5/1990 | Lunardi | 405/138 X |

FOREIGN PATENT DOCUMENTS

| | | |
|---|---|---|
| 59-84094 | 6/1984 | Japan . |
| 61-61000 | 3/1986 | Japan . |
| 62-94689 | 5/1987 | Japan . |
| 8601854 | 3/1986 | World Int. Prop. O. . |

OTHER PUBLICATIONS

Baumaschine & Bautechnik, BMT, vol. 29, No. 6, Jun. 1982, pp. 302-307, Wiesbaden, DE; A. Eber et al, "Bauverfahren für das Auffahren sehr grosser untertägiger Räume", p. 305, col. 2-p. 307, col. 2, FIGS. 2, 3, 5.

*Primary Examiner*—Dennis L. Taylor
*Attorney, Agent, or Firm*—Ronald P. Kananen

[57] ABSTRACT

A method of forming an underground cavern aiming at forming an underground cavern of a large scale at a very deep place in soft ground and soft rock layers safely and economically, and a tunneling machine suitable for use in carrying out the method. This method of forming an underground cavern consists of the steps of forming a ground reinforcing zone around a portion intended to be hollowed out before froming an underground cavern to be built, and then excavating the inside surrounded by the ground reinforcing zone. Further, the above-mentioned tunneling machine comprises a ring-shaped body having a first ring, a second ring, and a third ring; a boring device mounted between the second ring and propelling jacks for boring a plurality of holes extending radially from the inner surface of the tunnel into the ground; and a reinforcing material filling device mounted also between the second ring and the propelling jacks for filling a reinforcing material and a grout into each of the holes.

5 Claims, 6 Drawing Sheets

METHOD OF BUILDING UNDERGROUND CAVERN AND TUNNELING MACHINE

TECHNICAL FIELD OF THE INVENTION

This invention relates to a method of forming an underground cavern, and more particularly, to a method of building an underground cavern of a large scale at a very deep place, and a tunneling machine suitable for use in a part of the process of building an underground cavern.

BACKGROUND ART OF THE INVENTION

Underground caverns of a large scale built at very deep places of the kind mentioned above are extremely big caverns having a depth of about 100 meters and inside dimensions of about 100 meters, and are utilized for underground power stations and natural resources storing depots, etc. Such underground caverns are generally built in hard rock beds.

However, with the development of high-degree utilization of underground space of late years, there are strong demands for building such caverns of a large scale at very deep places in soft grounds even in urban communities.

In the case of building such caverns in soft grounds, two methods have so far been used. One method is to build earth retaining walls "a" so as to surround a required space and then excavate earth and sand within the space, as shown in FIG. 1; this is called, "Continuous Wall Building Method" (Open Excavating Method). Another method is to excavate a tunnel "b" of a large diameter during which lock bolts "c" are driven from the inner surface of the tunnel into the ground simultaneously with injection of a grout, and then form a concrete wall "d" on the inner surface by spraying cement mortor; this is called, NATM method.

Of the above-mentioned prior art methods, the former is disadvantageous in that, if a cavern or a tunnel is to be built at a very deep place, then the thickness of the earth retaining walls "a" must be increased, resulting in an increase in the earth retaining wall building cost. At the same time, the latter is a method which has been developed of late years for use in building tunnels in mountainous districts. In the case of the latter method, if the scale of the tunnel to be built is large, then the thickness of the rock beds to be reinforced becomes large, and reinforcing work is effected while excavation of the tunnel is being made. Therefore, there occur losses in time due to changes in arrangement of operations and uncertainty in ensuring safety during excavation.

SUMMARY OF THE INVENTION

The present invention has been made in view of the above-mentioned deficiencies in the prior art, and has for its object to provide a method of building an underground cavern, which enables an underground cavern of a large scale to be built safely and economically at a very deep place in soft ground, or in a soft rock bed, and also provide a tunneling machine suitable for use in carrying out the aforementioned method of building an underground cavern.

To achieve the above-mentioned object, according to a first aspect of the present invention, there is provided a method of building an underground cavern, comprising the steps of forming a ground reinforcing zone around a portion to be hollowed out prior to excavating the underground cavern to be formed, and then excavating the interior of the ground reinforcing zone thereby forming the underground cavern.

According to a second aspect of the present invention, there is provided a method of building an underground cavern as set forth in the first aspect, wherein the ground reinforcing zone forming step further comprises the steps of forming the ground reinforcing zone around the portion intended to be hollowed out; digging a vertical shaft from the ground surface to the uppermost portion of the ground reinforcing zone; providing a starting station at the lower end of the vertical shaft where a tunneling machine is started; taking the tunneling machine into the starting station; starting the tunneling machine from the starting station so as to advance in the ground reinforcing zone to thereby dig out a spirally extending tunnel around the portion to be hollowed out; digging out a plurality of a holes by means of a ground reinforcing unit mounted on the tunneling machine from the inner surface of the tunnel in radial and random directions and at regular intervals in longitudinal direction of the tunnel; and driving a member made from glass fibre and then injecting a grout by means of the ground reinforcing unit into each of the holes thus formed, thereby forming a reinforced portion within the predetermined ground reinforcing zone concurrently with the tunnel digging operation.

According to a third aspect of the present invention, there is provided a method of building an underground cavern as set forth in the first aspect, wherein the underground cavern forming step comprises the steps of running an excavator into the inside of the ground reinforced portion to dig out the inside portion, and covering the inner surface of the excavated portion with a lining material or the like.

According to a fourth aspect of the present invention, there is provided a method of building an underground cavern as set forth in the second aspect, wherein the spacing between vertically adjacent rows of the tunnel is set such that the adjacent portions reinforced by driving glass fibre member and injecting a grout in radial and random directions may overlap with each other.

According to a fifth aspect of the present invention, there is provided a method of building an underground cavern as set forth in the first aspect, wherein the ground reinforcing zone forming step further comprises the steps of forming a ground reinforcing zone around a portion intended to be hollowed out; digging a vertical shaft from the ground surface to the uppermost portion of the ground reinforcing zone; digging out a plurality of horizontal tunnels each having substantially the same length and extending radially from the lower end of the vertical shaft; digging out a circular tunnel in such a way as to connect the leading ends of these horizontal tunnels, respectively; digging a plurality of vertical tunnels each having a predetermined length and extending downwards from the leading ends of the horizontal tunnels at a plurality of predetermined positions along the circumference of the circular tunnel; digging out a plurality of holes by means of a ground reinforcing unit mounted on the tunneling machine from the inner surfaces of the horizontal, circular and vertical tunnels in radial and random directions and at regular intervals in the longitudinal directions of the tunnels; and driving a glass fibre member and then injecting a grout by means of the ground reinforcing unit into each of the holes thus formed, thereby forming a reinforced portion within the predetermined ground reinforcing zone concurrently with the digging operations of the radially extending horizontal tunnels, the circular tunnel and the vertical tunnels.

According to a sixth aspect of the present invention, there is provided a method of building an underground cavern as set forth in the first aspect, wherein the ground reinforcing zone forming step further comprises the steps of forming a ground reinforcing zone around a portion intended to be hollowed out; digging a plurality of vertical tunnels extending from the ground surface over the whole ground reinforcing zone; digging out a plurality of holes by means of a ground reinforcing unit mounted on the tunneling machine from the inner surfaces of the portions of the vertical tunnels corresponding to the ground reinforcing zone in radial and random directions and at regular intervals in the longitudinal direction of the tunnels; and driving a glass fibre member and then injecting a grout by means of the ground reinforcing unit into each of the holes thus formed, thereby forming reinforced portions within the predetermined ground reinforcing zone concurrently with the digging operations of the vertical tunnels.

To achieve the above-mentioned object, according to a seventh aspect of the present invention, there is provided a tunneling machine having a cutter drum mounted on the leading end side of a ring-shaped machine body having an articulated construction and adapted, when it is rotated, to excavate earth and sand and send the spoil into the internal part of the machine body, and propelling jacks mounted on the rear part of the machine body, the tunneling machine further comprising a boring device mounted between the ring-shaped body and the propelling jacks for boring a plurality of holes extending substantially radially from the inner surface of a tunnel to be built; and a ground reinforcing unit having a reinforcing material filling means for filling reinforcing materials such as glass fibre or a lock bolt and a grout, etc. into each of the holes.

According to an eighth aspect of the present invention, there is provided a tunneling machine as set forth in the seventh aspect, wherein the ring-shaped body comprises a first ring having a small diameter portion formed in the rear part thereof; a second ring having a small diameter portion formed in the rear part thereof and also having a large diameter front portion in which the small diameter rear portion of the first ring is loosely fitted through the intermediary of a sealing member; and a third ring having an annular frame which is open in the rear end portion thereof for molding a lining material and having a large diameter front portion in which the small diameter rear portion of the second ring is loosely fitted through the intermediary of a sealing member, characterized in that the first ring is concentrically interconnected with the second ring by a plurality of steering jacks mounted on the inner peripheries of the rings, and the second ring is concentrically interconnected with the third ring by a plurality of propelling jacks mounted on the inner peripheries of the rings.

According to a ninth aspect of the present invention, there is provided a tunneling machine as set forth in the seventh aspect, characterized in that the above-mentioned boring device comprises a turning frame which consists of an annular frame supported rotatably through bearings on the inner surface of the second ring, and a girder frame fixedly secured on the inner surface of the annular frame; and a rotary striking type borer mounted on one side of the girder frame of the turning frame in such a manner that it may be moved in the directions at right angles to the axis of the second ring, and the above-mentioned ground reinforcing unit comprises a glass fibre reel mounted on the other side of the girder frame; a glass fibre feeding means mounted adjacent to the glass fibre reel for feeding a glass fibre member supplied by the reel in turn into each of a plurality of holes bored by the boring device; a grout material storage tank which is located on the girder frame and to which a grout injection means is connected; and a reinforcing material supply unit mounted on the inner surface of the annular frame opposite to the glass fibre feeding means for supplying a glass fibre member and a grout in turn into each of the holes bored in the ground.

According to the method of building an underground cavern according to the present invention incorporating the above-mentioned aspects, an underground cavern of a large scale can be built safely and economically in a soft ground or in a soft rock bed at a very deep place. Further, by using the tunneling machine according to the present invention incorporating the above-mentioned aspects, a reinforcing zone can be formed efficiently around a cavern to be built prior to excavating the latter.

The above-mentioned and other objects, aspects and advantages of the present invention will become apparent to those skilled in the art by making reference to the following description and the accompanying drawings in which preferred embodiments incorporating the principles of the present invention are shown by way of example only.

DETAILED DESCRIPTION OF PREFERRED EMBODIMENTS

The present invention will now be described below by way of several embodiments with reference to FIGS. 3 to FIG. 14.

Figure 1:
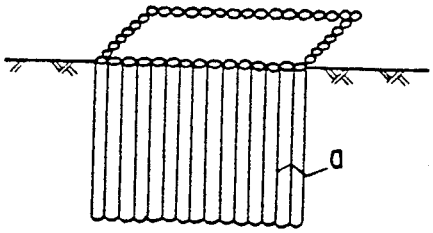
FIG. 1 PRIOR ART
FIGS. 1 and 2 are explanatory views showing respective prior art methods of building an underground cavern.
Figure 2:
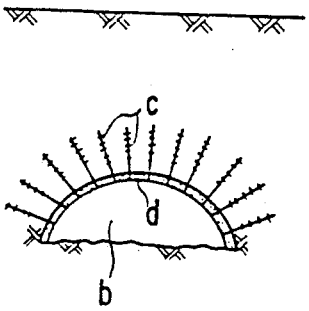
FIG. 2 PRIOR ART
Figure 5:
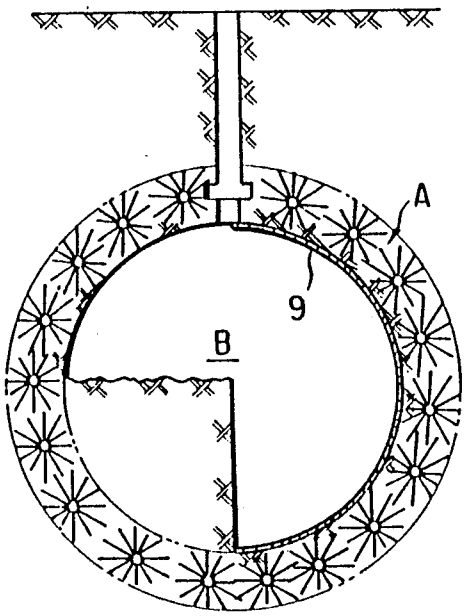
FIGS. 3, 4, and 5 are explanatory views showing respective work steps of a first embodiment of the method according to the present invention.
Figure 4:
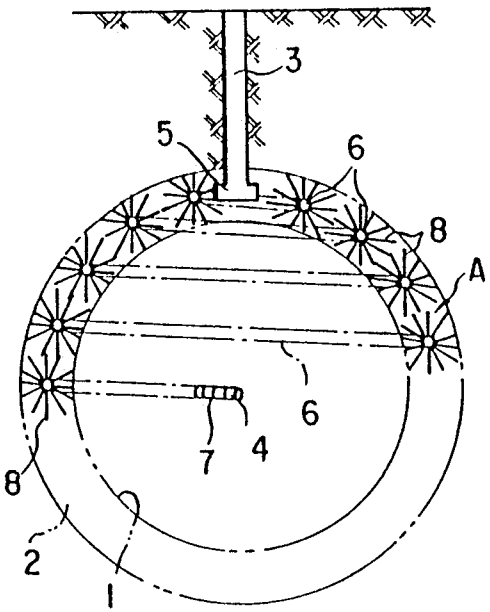
Figure 3:
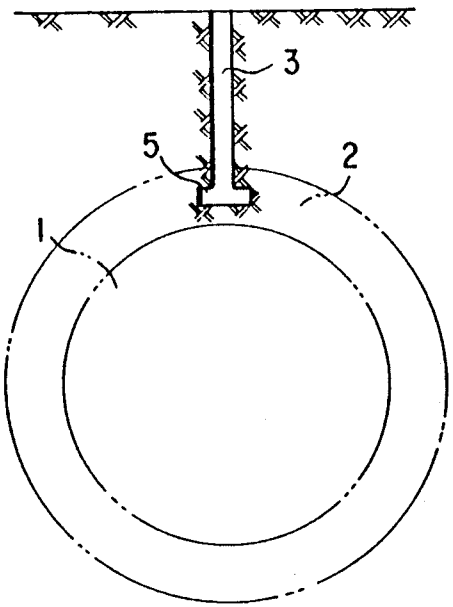

A first embodiment of the method of building an underground cavern according to the present invention will now be described with reference to FIGS. 3, 4 and 5. FIGS. 3, 4 and 5 are explanatory views showing work steps for carrying out the method according to the first embodiment.

FIRST STEP (FIG. 3)

A ground reinforcing zone 2 is formed around a portion 1 intended to be hollowed out later. After that, a vertical shaft 3 is formed from the ground to the uppermost portion of the ground reinforcing zone 2, and a tunneling machine starting station 5 is formed in the lower end of the shaft 3, where a tunneling machine 4 which will be described later begins to dig out a tunnel.

SECOND STEP (FIG. 4)

The tunneling machine 4 is lowered to the starting station 5 and then started therefrom so as to move forwards in the above-mentioned ground reinforcing zone 2 to thereby dig out a spirally extending tunnel around a portion 1 intended to be hollowed out later. To form a ground reinforcing portion A in the above-mentioned predetermined reinforcing zone 2 concurrently with the digging operation, a plurality of holes are formed by a ground reinforcing unit 7 mounted on the tunneling machine 4 from the inner surface of the tunnel 6 in radial and random directions and at regular intervals in the longitudinal direction of the tunnel 6, and a glass fibre member is driven and then a grout is injected by the ground reinforcing unit in turn into each of the holes thus formed, thereby forming a plurality of pairs of reinforcing arms 8 along the tunnel 6. In this case, the spacing between the vertically adjacent rows of the spirally extending tunnel 6 is set such that the reinforcing arms 8 of the vertically adjacent rows may overlap with each other. Further, the spirally extending tunnel 6 is not to be limited only to one length, as shown, a plurality of lengths of independent tunnels 6 may be provided by using a plurality of tunneling machines 4. By effecting the above-mentioned operation, the ground reinforcing portion A can be formed around the portion 1 to be hollowed out to form the cavern.

THIRD STEP (FIG. 5)

Next, an excavator is run into the zone surrounded by the ground reinforcing portion A formed by the second step and is operated to excavate this zone. After that, the inner surface of the cavern thus formed is lined with a lining material 9 to thereby complete a cavern B. In this case, taking in and out of the tunneling machine and removal of the soil are effected through the vertical shaft 3.

Figure 6:
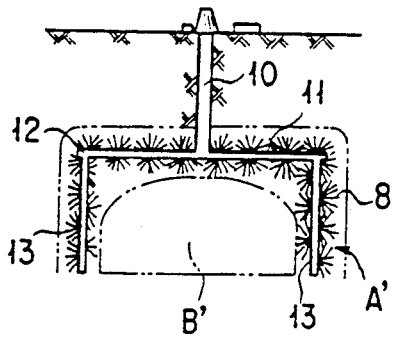
FIGS. 6 and 7 are explanatory views showing a second embodiment of the method of the present invention.
Figure 7:
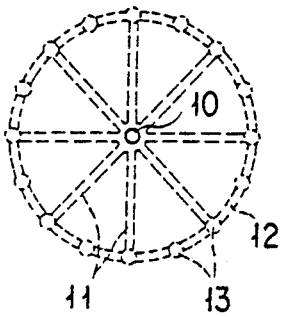

FIGS. 6 and 7 show a second embodiment of the method of the present invention.

In this embodiment, a plurality of horizontal tunnels 11 having substantially the same length are formed so as to extend radially from the lower end of a vertical shaft 10 which is formed by digging down from the ground surface. Thereafter, a circular tunnel 12 is formed to connect the leading ends of the horizontal tunnels 11. After that, vertical tunnels 13 are digged down such that they extend downwards from a plurality of predetermined positions along the circumference of the tunnel 12 including the leading ends of the tunnels 11. After that, reinforcing arms 8 each comprising a glass fibre member and a grout which are driven, in turn, from the inner surfaces of the tunnels 11, 12 and 13 in radial and random directions and at regular intervals along the tunnels, in the same manner as the above-mentioned first embodiment, thereby forming a ground reinforcing portion A'.

After that, the internal zone surrounded by the reinforcing portion A' is excavated by an excavator so to form a cavern B'.

Figure 8:
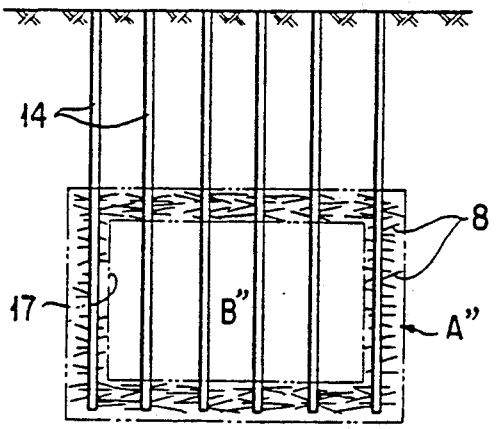
FIG. 8 is an explanatory view showing a third embodiment of the method of the present invention.

FIG. 8 shows a third embodiment of the method of the present invention.

In this embodiment, a plurality of vertical tunnels 14 are formed so as to extend downwards from the ground surface, and at the same time, a ground reinforcing portion A" surrounding a portion 17 to be hollowed out is formed by a plurality of pairs of reinforcing arms 8, each pair of which is formed by digging a plurality of holes from the inner surfaces of the vertical tunnels 14 corresponding to the predetermined ground reinforcing zone in radial and random directions and at regular intervals along the tunnels, and driving a glass fibre member and then injecting a grout into each of the holes.

After that, the portion 17 to be hollowed out is excavated to form a cavern B".

Figure 9:
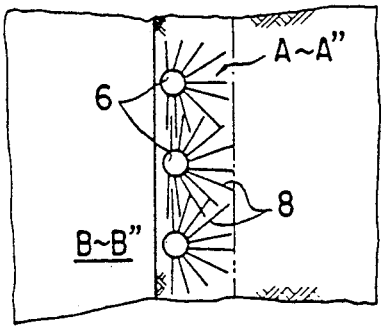
FIG. 9 is a fragmentary sectional view showing another embodiment of the reinforcing portion which is formed by the method of the present invention.

FIG. 9 shows an embodiment of the configuration of a reinforcing portion in the ground reinforcing zone A~A" wherein reinforcing arms 8 are directed to the outside of the caverns B~B".

Figure 10:
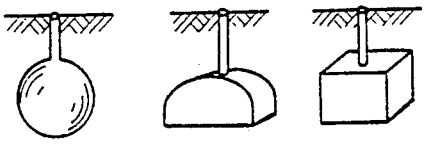
FIG. 10 is a schematic explanatory view showing three examples of caverns having different shapes.
Figure 11:
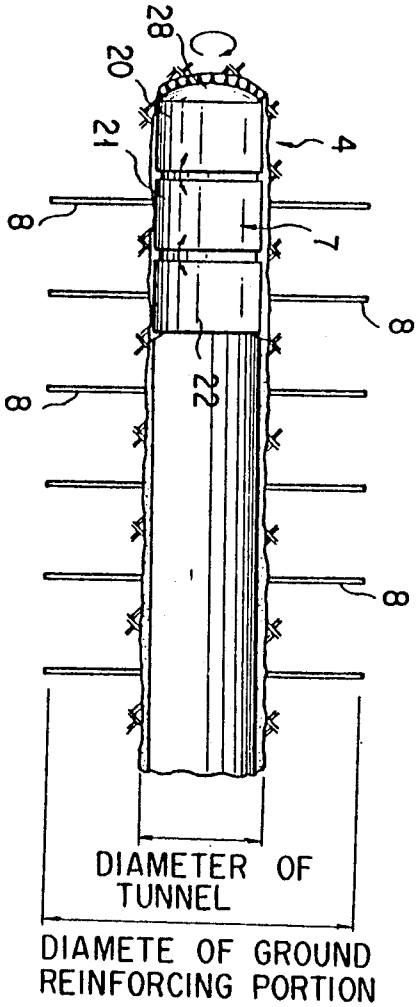
FIG. 11 is a schematic, overall side elevational view of a tunneling machine used to carry out the method of the present invention.
Figure 12:
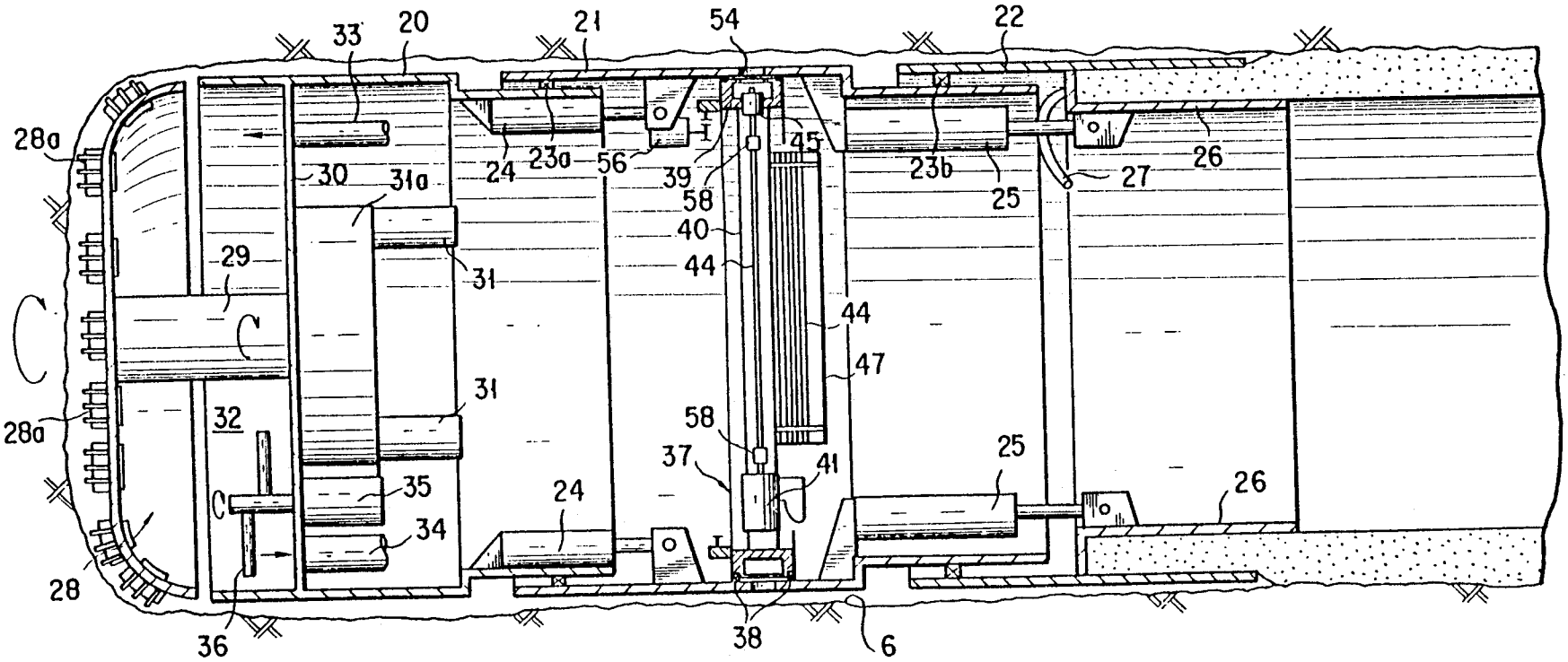
FIG. 12 is a longitudinal sectional view of the principal parts of the tunneling machine shown in FIG. 11.
Figure 14:
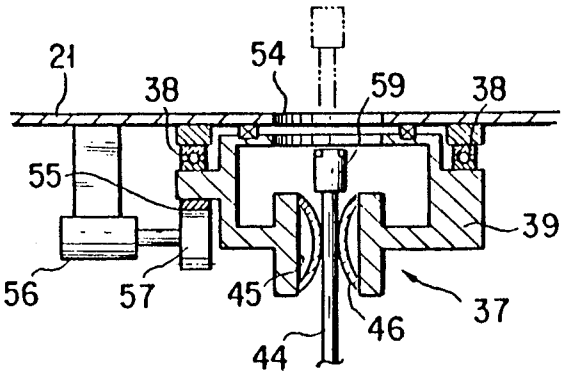
FIG. 14 is a sectional view of principal parts of a boring device for use in the tunneling machine.
Figure 13:
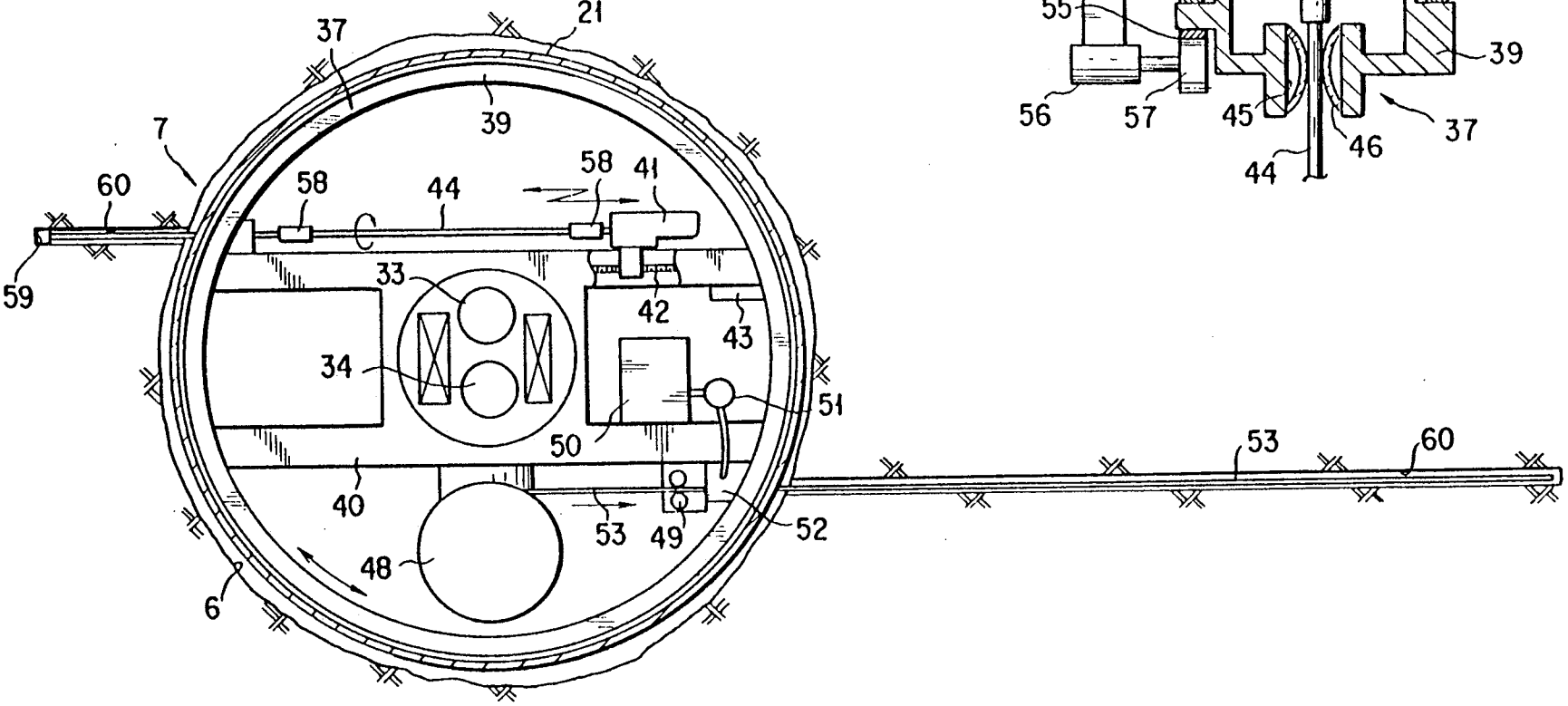
FIG. 13 is a cross-sectional view of the principal parts of the tunneling machine.

The shapes of the above-mentioned caverns B~B" include a spherical shape, a semicylindrical shape, and a rectangular parallelpiped, etc., as shown in FIG. 10.

At the same time, in the above-mentioned embodiments, the reinforcing zones A~A" are shown as being formed by glass fiber members and grout, such reinforcing zones may be formed by reinforcing means such as insertion of lock bolts, injection of a chemical, or freezing, etc.

Next, an embodiment of the tunneling machine 4 suitable for use in carrying out the method of the present invention will be described with reference to FIGS. 11 to 14.

In the drawings, reference numeral 20 denotes a first ring, 21 a second ring, and 22 a third ring, all of which are of a cylindrical shape. The rear portion of each of the first and second rings 20 and 21 is smaller in diameter than each of their respective front portions. The small diameter rear portion of the first ring 20 is loosely fitted in the large diameter front portion of the second ring 21 through the intermediary of a sealing member 23*a*. At the same time, the small diameter rear portion of the second ring 21 is loosely fitted in the large diameter front portion of the third ring 22 through the intermediary of a sealing member 23*b*. The first ring 20 is concentrically connected to the second ring 21 by means of steering jacks 24, whilst the second ring 21 is concentrically connected to the third ring 22 by means of propelling jacks 25. A plurality of jacks 24 and a plurality of jacks 25, respectively are mounted circumferentially of the rings. The third ring 22 has an annular frame 26 formed in the rear part thereof, and which is open rearwardly for molding a lining material. A lining material injection pipe 27 is connected to the annular frame 26.

Reference numeral 28 denotes a cutter drum mounted in front of the first ring 20. This cutter drum 28 has a support shaft 29 which is supported together with a reduction gear 31*a* and motors 31 by a shaft support wall 30 mounted within the first ring 20. The cutter drum 28 is arranged to be rotated through the support shaft 29 by the motors 31. The cutter drum 28 has disk cutters 28*a* mounted thereon and an earth and sand or spoil intake (not shown) formed therein. The arrangement is made such that when the cutter drum 28 is rotated the earth and sand in front thereof is excavated and the spoil is taken through the spoil intake into a chamber 32 defined between the support wall 30 of the first ring 20 and the cutter drum 28. A mud supply pipe 33 and a mud discharge pipe 34 extend into this chamber 32. Further, an agitator 36 connected to a motor 35 is mounted in the chamber 32.

The portion of the above-mentioned second ring 21 is the ground reinforcing unit 7 mounted on the tunneling machine 4 which is already mentioned in the description of the method of forming an underground cavern. The configuration of the ground reinforcing unit 7 will be described below with reference to FIGS. 12, 13 and 14.

A turning frame 37 is rotatably supported concentrically with the second ring 21 and within the latter. This turning frame 37 comprises an annular frame 39 supported rotatably by bearings 38, 38 on the inner surface of the second ring 21, and a girder frame 40 fixedly secured to the inner surface of the annular frame 39. A rotary striking type boring device 41 is mounted on one side of the girder frame 40 in such a manner that it may be moved at right angles to the axis of the second ring 21, and is threadably engaged with a feed screw 42. Reference numeral 43 denotes a feed motor. As is apparent from FIG. 14, the portion of the annular frame 39 opposite to the axis of the above-mentioned rotary striking type boring device 41 has a hole 45 formed therein and through which a boring rod 44 is passed. The hole 45 has sealing members 46 attached to the inner surface thereof. The girder frame 40 is provided with a rod receiver 47 accommodating boring rods 44 for connection purposes. Further, the girder frame 40 is provided with a glass fibre reel 48, a glass fibre feeding means 49, a grout material storage tank 50, and a grout injection means 51. The leading ends of the glass fibre feeding means 49 and the grout injection means 51 are connected to a reinforcing material supply unit 52. This reinforcing material supply unit 52 includes a sealing member applied to the inner surface of the second ring 21, and a cutter member for cutting a glass fibre 53, and both of the sealing member and the cutter member are not shown. Further, this reinforcing material supply unit 52 and the hole 45 through which the above-mentioned boring rod 44 is passed are located in one and the same plane perpendicular to the axis of the second ring 21.

The above-mentioned second ring 21 has holes 54 formed at a plurality of places along the circumference thereof and in a plane containing the hole 45 of the turning frame 37 through which the boring rod 44 is passed, and the reinforcing material supply unit 52.

The annular frame 39 of the tuning frame 37 has a ring gear 55 mounted thereon and which meshes with a drive gear 57 connected to the turning motor 56.

The operation of the tunneling machine 4 constructed as mentioned above will be described below.

By rotating the cutter drum 28 while the tunneling machine 4 is pushed ahead by the propelling jacks 25, the tunneling machine 4 is moved forwards while it is digging out a tunnel end face to form a tunnel 6. The earth and sand excavated at that time or the spoil is taken once into a chamber 32 from where the spoil is discharged rearwards through the mud discharge pipe 34. The inner surface of the tunnel 6 thus formed by excavation is lined with a lining material injected onto the inner surface thereof, with the aid of the annular frame 26 mounted on the rear end portion of the third ring 22. This lining material is of the property which becomes hard in a short time, and the tunneling machine 4 is propelled using the hardened lining as a foothold.

Steering of the tunneling machine 4 is made by changing the angle of excavation between the first ring 20 and the second ring 21 by the action of the steering jacks 24.

Next, operation of reinforcing the inner wall of the tunnel with a reinforcing material while the tunnel is being formed by the above-mentioned tunneling machine 4 is discussed.

First of all, the propulsion of the tunneling machine 4 by the propelling jacks 25 is stopped. (Even if the steering jacks 24 and the cutter drum 28 are then operating, it does not matter.) At the same time, a boring rod 44 having a bit 59 fixedly secured to the leading end thereof is connected to a drive shaft of the rotary striking type boring device 41 by means of joints 58. Next, the turning frame 37 is turned by the turning motor 56 so as to locate the bit 59 opposite to the hole 54 formed in the second ring 21, and in this condition the rotary striking type boring device 41 is advanced by the feed screw 42 thereby advancing the boring rod 44 into the ground.

As a result, a hole 60 is bored in the ground.

The depth of the hole 60 can be adjusted to a value as required by connecting a plurality of the above-mentioned boring rods 44 by means of the joints 58 successively and in series.

By turning the turning frame 37 successively, a multiplicity of holes 60 can be bored in consecutive order in the tunnel wall around the second ring 21.

Subsequently, the reinforcing material supply unit 52 is located opposite to each of the holes 60 formed as mentioned above in consecutive order, and then glass fibre member 53 is inserted into each of the holes 60 and then a grout material is injected into each of the holes 60 by the reinforcing material supply unit 52. The above-mentioned glass fibre member 53 is fed from the glass fibre reel 48 through the glass fibre feeding means 49 into the reinforcing material supply unit 52, and then a grout material is injected by the grout injection means 51 into the reinforcing material supply unit 52.

Thus, the tunnel 6 around the second ring 21 forming a portion of the ground reinforcing unit 7 is formed with a multiplicity of radially extending reinforcing arms 8, each being comprised of the glass fibre member 53 and the grout. By conducting the above-mentioned operation each time the tunneling machine 4 has formed the ground over a predetermined distance, the above-mentioned radially extending reinforcing arms 8 can be formed at regular intervals over the overall length of the tunnel 6, so that the extent of reinforcement by the reinforcing arms 8 will become any one of reinforcing zones A, A' and A".

Further, whilst the above-mentioned embodiments show exampies wherein the glass fibre member 53 is used as the reinforcing material, a lock bolt may be used in place of the glass fibre member. In that case, the lock bolt is inserted into the hole 60 by means of a feeding mechanism which is substantially the same as the above-mentioned boring device.

What is claimed is:

1. A method of building an underground cavern having a ground reinforcing zone, comprising the steps of:

digging a shaft from the ground surface to a location corresponding to a portion of said ground reinforcing zone;

providing a starting station at said location corresponding to a portion of said ground reinforcing zone;

providing a tunneling machine in said starting station;

advancing said tunneling machine from said starting station so as to dig out a series of tunnels, said tunnels enclosing a portion to be hollowed out;

digging a plurality of holes from the inner surfaces of said tunnels in radial and random directions and at regular intervals in the longitudinal direction of said tunnels;

driving a reinforcing fibre member and then injecting a grout into each of said holes, thereby forming a reinforced portion within said ground reinforcing zone; and excavating the interior of said ground reinforcing zone, thereby forming said underground cavern.

2. A method of building an underground cavern having a ground reinforcing zone, comprising the steps of:

digging a vertical shaft from the ground surface to the uppermost portion of said ground reinforcing zone;

providing a starting station at the lower end of said vertical shaft;

providing a tunneling machine in said starting station;

advancing said tunneling machine from said starting station so as to dig out a spirally extending tunnel around a portion to be hollowed out;

digging out a plurality of holes by means of a ground reinforcing unit mounted on said tunneling machine from the inner surface of the tunnel in radial and random directions and at regular intervals in the longitudinal direction of the tunnel;

driving a glass fibre member and then injecting a grout by means of said ground reinforcing unit into each of the holes thus formed, thereby forming a reinforced portion within said ground reinforcing zone concurrently with the tunnel digging operation; and excavating an interior of said ground reinforcing zone thereby forming an underground cavern.

3. The method of building an underground cavern as claimed in claim 2, wherein the spacing between vertically adjacent rows of said spirally extending tunnel are set such that the adjacent portions reinforced by driving said glass fibre member and injecting said grout in radial and random directions may overlap with each other.

4. A method of building an underground cavern having a ground reinforcing zone comprising the steps of:

digging a vertical shaft from the ground surface to the uppermost portion of said ground reinforcing zone;

digging out a plurality of horizontal tunnels each having substantially the same length and extending radially from a lower end of the vertical shaft by means of a tunneling machine;

digging out a circular tunnel by means of said tunneling machine in such a way as to connect the leading ends of said horizontal tunnels, respectively;

digging by means of said tunneling machine a plurality of vertical tunnels each having a predetermined length and extending downwards from the leading ends of said horizontal tunnels at a plurality of predetermined positions along the circumference of the circular tunnel;

digging out a plurality of holes by means of a ground reinforcing unit mounted on said tunneling machine from the inner surfaces of said horizontal, circular and vertical tunnels in radial and random directions and at regular intervals in the longitudinal directions of said tunnels;

driving a glass fibre member and then injecting a grout by means of said ground reinforcing unit into each of said holes, thereby forming a reinforced portion within said ground reinforcing zone concurrently with said digging of said radially extending horizontal tunnels, said circular tunnel and said vertical tunnels; and excavating an interior of said ground reinforcing zone, thereby forming said underground cavern.

5. A method of building an underground cavern having a ground reinforcing zone comprising the steps of:

digging a plurality of vertical tunnels by means of a tunneling machine extending from the ground surface over the whole ground reinforcing zone; digging out a plurality of holes by means of a reinforcing unit mounted on said tunneling machine from the inner surfaces of the portions of the vertical tunnels corresponding to said ground reinforcing zone in radial and random directions and at regular intervals in the longitudinal direction of the tunnels;

driving a glass fibre member and then injecting a grout by means of said ground reinforcing unit into each of said holes, thereby forming reinforced portions within said predetermined ground reinforcing zone concurrently with said digging of said vertical tunnels; and excavating an interior of said ground reinforcing zone, thereby forming said underground cavern.

* * * * *